US009989923B2

(12) United States Patent
Kobayashi et al.

(10) Patent No.: US 9,989,923 B2
(45) Date of Patent: Jun. 5, 2018

(54) ELECTRONIC TIMEPIECE

(71) Applicant: Seiko Epson Corporation, Tokyo (JP)

(72) Inventors: Atsushi Kobayashi, Shiojiri (JP); Takahiro Watanabe, Okaya (JP); Shuichi Tamura, Matsumoto (JP)

(73) Assignee: Seiko Epson Corporation (JP)

( * ) Notice: Subject to any disclaimer, the term of this patent is extended or adjusted under 35 U.S.C. 154(b) by 0 days. days.

(21) Appl. No.: 15/583,094

(22) Filed: May 1, 2017

(65) Prior Publication Data

US 2017/0315510 A1 Nov. 2, 2017

(30) Foreign Application Priority Data

May 2, 2016 (JP) ..... 2016-092586
Feb. 13, 2017 (JP) ..... 2017-024054

(51) Int. Cl.
*G04B 37/22* (2006.01)
*G04R 60/12* (2013.01)
*C22C 14/00* (2006.01)

(52) U.S. Cl.
CPC ..... *G04B 37/22* (2013.01); *C22C 14/00* (2013.01); *G04R 60/12* (2013.01)

(58) Field of Classification Search
CPC ..... G04B 37/22; G04R 60/12; C22C 14/00
See application file for complete search history.

(56) References Cited

U.S. PATENT DOCUMENTS 2,864,697 A * 12/1958 Busch ..... C22C 14/00 148/407
4,857,268 A * 8/1989 Huang ..... C22C 14/00 148/403
5,980,655 A * 11/1999 Kosaka ..... C22C 14/00 148/421
6,267,499 B1 * 7/2001 Damasko ..... G04B 37/0008 368/280
8,932,437 B2 * 1/2015 Derrig ..... C23C 14/0015 204/192.1
2009/0074604 A1 * 3/2009 Chen ..... C22C 1/051 419/18
2009/0181844 A1 * 7/2009 Hashimoto ..... A61K 8/25 501/135
2012/0118444 A1 * 5/2012 Soniak ..... C22C 14/00 148/669
2016/0138149 A1 * 5/2016 Bryan ..... C22C 14/00 148/671
2018/0016670 A1 * 1/2018 Bryan ..... C22F 1/18

FOREIGN PATENT DOCUMENTS

JP 2009-065523 A 3/2009

* cited by examiner

*Primary Examiner* — Vit W Miska
(74) *Attorney, Agent, or Firm* — Harness, Dickey & Pierce, P.L.C.

(57) ABSTRACT

An electronic timepiece includes an outer case, a back cover, and an antenna for receiving radio waves disposed in the outer case, wherein at least one of the outer case and the back cover is formed from a titanium alloy composed of aluminum in an amount of 3.50 mass % or more and 4.50 mass % or less and vanadium in an amount of 20.00 mass % or more and 23.00 mass % or less, with the remainder including titanium and impurities.

7 Claims, 5 Drawing Sheets

ELECTRONIC TIMEPIECE

BACKGROUND

1. Technical Field

The present invention relates to an electronic timepiece incorporating an antenna which receives radio waves such as standard radio waves.

2. Related Art

In the past, there has been known an electronic timepiece which receives standard radio waves through an antenna and performs processing such as time correction.

As such an electronic timepiece, there has been known an electronic timepiece using JIS Class 60 titanium alloy as a material of a case or a back cover (see JP-A-2009-65523).

However, the JIS Class 60 titanium alloy is an intractable material, and in the case where a timepiece case or a back cover is produced with the JIS Class 60 titanium alloy, a cutting process is needed and the productivity is low, and therefore, it has a problem that practical application is difficult.

SUMMARY

An advantage of some aspects of the invention is to provide an electronic timepiece capable of preventing the decrease in sensitivity of receiving radio waves, and also capable of improving productivity.

An electronic timepiece according to an aspect of the invention includes an outer case, a back cover, and an antenna for receiving radio waves disposed in the outer case, wherein the outer case and the back cover are formed from a titanium alloy composed of aluminum in an amount of 3.50 mass % or more and 4.50 mass % or less and vanadium in an amount of 20.00 mass % or more and 23.00 mass % or less, with the remainder including titanium and impurities.

Here, the impurities are, for example, inevitable impurities and the like unintentionally incorporated in the production process, and specific examples thereof include N (nitrogen), C (carbon), H (hydrogen), Fe (iron), and O (oxygen).

According to the above aspect of the invention, the outer case and the back cover are formed from a titanium alloy (so-called JIS Class 80 titanium alloy) composed of Al (aluminum) in an amount of 3.50 mass % or more and 4.50 mass % or less and V (vanadium) in an amount of 20.00 mass % or more and 23.00 mass % or less, with the remainder including Ti (titanium) and impurities, and therefore, the outer case and the back cover can be produced by cold forging or the like. Due to this, as compared with the case where JIS Class 60 titanium alloy is used, the productivity of the outer case and the back cover can be improved, and also the dimensional accuracy of the outer case and the back cover, which is important when reducing the thickness or size of the timepiece, can be improved.

Further, the JIS Class 80 titanium alloy has a higher specific resistance than pure Ti (titanium) or stainless steels such as SUS 304 and SUS 316 in the same manner as the JIS Class 60 titanium alloy, and therefore, a loss due to an eddy current can be reduced. Due to this, while maintaining the receiving sensitivity, a distance between the outer case or the back cover and the antenna can be decreased, and a reduction in the thickness of the electronic timepiece or a reduction in the size of the case can be achieved.

An electronic timepiece according to another aspect of the invention includes an outer case, a back cover, and an antenna for receiving radio waves disposed in the outer case, wherein the back cover is formed from a titanium alloy composed of aluminum in an amount of 3.50 mass % or more and 4.50 mass % or less and vanadium in an amount of 20.00 mass % or more and 23.00 mass % or less, with the remainder including titanium and impurities.

According to the above aspect of the invention, the back cover is formed from so-called JIS Class 80 titanium alloy, and therefore, the back cover can be produced by cold forging or the like. Due to this, as compared with the case where JIS Class 60 titanium alloy is used, the productivity of the back cover can be improved, and also the dimensional accuracy of the back cover, which is important when reducing the thickness of the timepiece, can be improved.

Further, the JIS Class 80 titanium alloy has a higher specific resistance than pure Ti (titanium) or stainless steels such as SUS 304 and SUS 316 in the same manner as the JIS Class 60 titanium alloy, and therefore, a loss due to an eddy current can be reduced. Due to this, while maintaining the receiving sensitivity, a distance between the back cover and the antenna can be decreased, and a reduction in the thickness of the electronic timepiece or the case can be achieved. The outer case is formed from a material other than the JIS Class 80 titanium alloy such as pure Ti.

An electronic timepiece according to another aspect of the invention includes an outer case, a back cover, and an antenna for receiving radio waves disposed in the outer case, wherein the outer case is formed from a titanium alloy composed of aluminum in an amount of 3.50 mass % or more and 4.50 mass % or less and vanadium in an amount of 20.00 mass % or more and 23.00 mass % or less, with the remainder including titanium and impurities.

According to the above aspect of the invention, the outer case is formed from so-called JIS Class 80 titanium alloy, and therefore, the outer case can be produced by cold forging or the like. Due to this, as compared with the case where JIS Class 60 titanium alloy is used, the productivity of the outer case can be improved, and also the dimensional accuracy of the outer case, which is important when reducing the thickness or size of the timepiece, can be improved.

Further, the JIS Class 80 titanium alloy has a higher specific resistance than pure Ti (titanium) or stainless steels such as SUS 304 and SUS 316 in the same manner as the JIS Class 60 titanium alloy, and therefore, a loss due to an eddy current can be reduced. Due to this, while maintaining the receiving sensitivity, a distance between the outer case and the antenna can be decreased, and a reduction in the size of the electronic timepiece or the case can be achieved. The back cover is formed from a material other than the JIS Class 80 titanium alloy such as pure Ti.

In the electronic timepiece according to any of the above aspects of the invention, it is preferred that the antenna includes an antenna core and a coil wound around the antenna core, and a gap dimension between the antenna core and the back cover is set to 2.05 mm or less and 1.55 mm or more.

According to the above aspect of the invention, the gap dimension between the antenna core and the back cover can be decreased to 2.05 mm or less, and therefore, the thickness of the electronic timepiece can be reduced. Further, since the gap dimension is set to 1.55 mm or more, a minimum gap dimension (for example, 0.28 mm) between a module including the antenna and the back cover can also be ensured.

In the electronic timepiece according to any of the above aspects of the invention, it is preferred that the antenna includes an antenna core and a coil wound around the antenna core, and a gap dimension between the antenna core and the outer case is set to 1.10 mm or less and 0.50 mm or more.

According to the above aspect of the invention, the gap dimension between the antenna core and the outer case, that is, the gap dimension of a portion where the antenna core and the inner surface of the outer case come closest to each other can be decreased to 1.10 mm or less, and therefore, the size of the case can be reduced, and thus, the electronic timepiece can be realized as an electronic timepiece intended for women. Further, since the gap dimension between the antenna core and the outer case is set to 0.50 mm or more, the number of turns of a coil can also be ensured.

BRIEF DESCRIPTION OF THE DRAWINGS

Embodiments of the invention will be described with reference to the accompanying drawings, wherein like numbers reference like elements.

DESCRIPTION OF EXEMPLARY EMBODIMENTS

Hereinafter, embodiments of the invention will be described with reference to the drawings.

Figure 1:
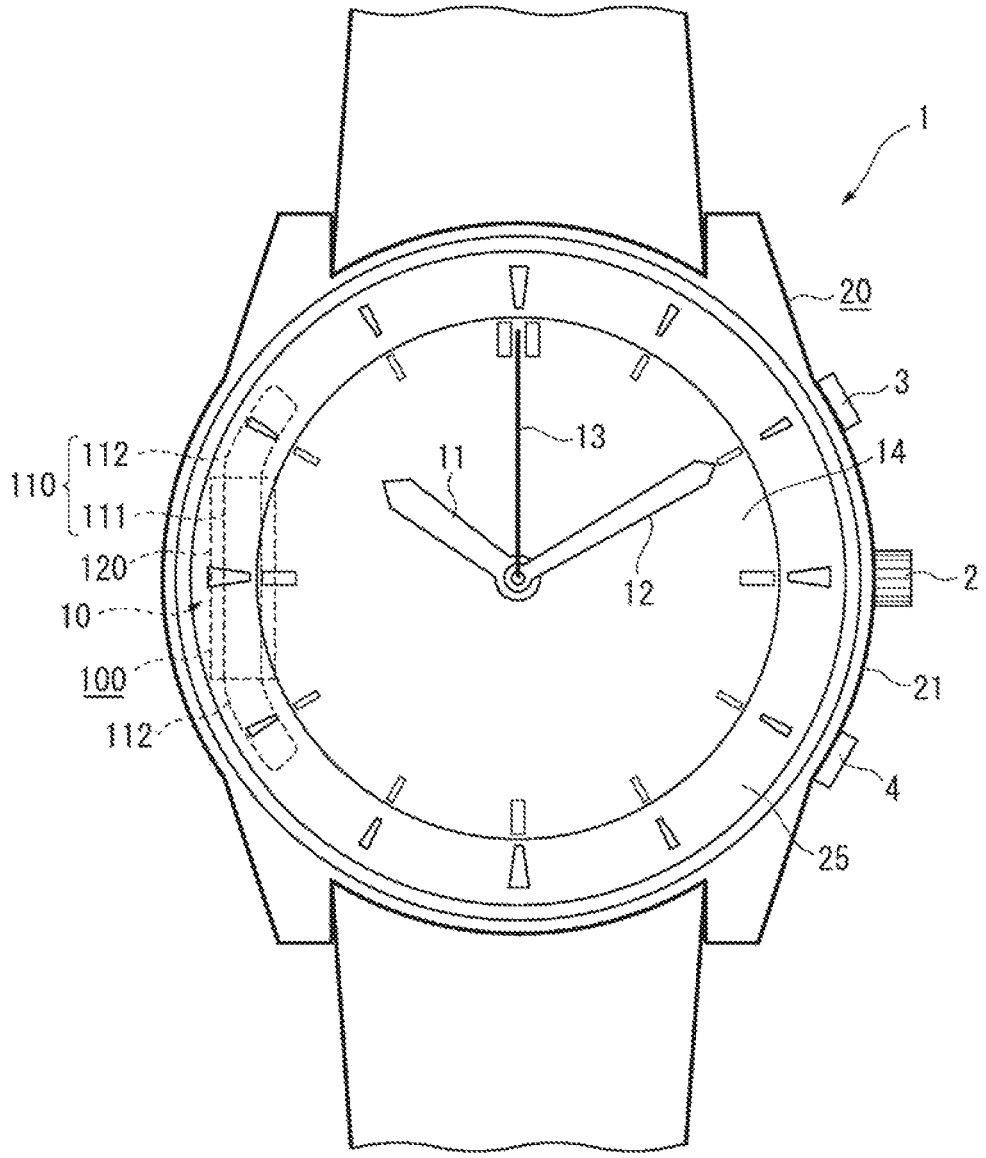
FIG. 1 is a plan view showing an electronic timepiece according to an embodiment of the invention.

As shown in FIG. 1, an electronic timepiece 1 of this embodiment is a pointer type watch (analog timepiece) which includes an hour hand 11, a minute hand 12, a second hand 13, and a dial plate 14. This electronic timepiece 1 receives a long wave standard radio wave as a radio wave including time information and corrects the pointing positions of the hour hand 11, the minute hand 12, and the second hand 13 based on the received time information.

The electronic timepiece 1 further includes a module (movement) 10 in which an antenna 100 that receives a standard radio wave and various components for controlling the driving of the hour hand 11, the minute hand 12, and the second hand 13 are incorporated, an outer case 20 in which the module 10 and the like are housed, a crown 2 with which time adjustment or the like is performed, and buttons 3 and 4 with which a receiving operation or the like is performed.

The dial plate 14 is preferably formed from, for example, a non-conductive material such as a synthetic resin or a glass, and due to this, it becomes possible to allow the antenna 100 to favorably receive a standard radio wave entering from the below-mentioned cover glass 24 side (the surface side of the timepiece) without being inhibited.

Figure 2:
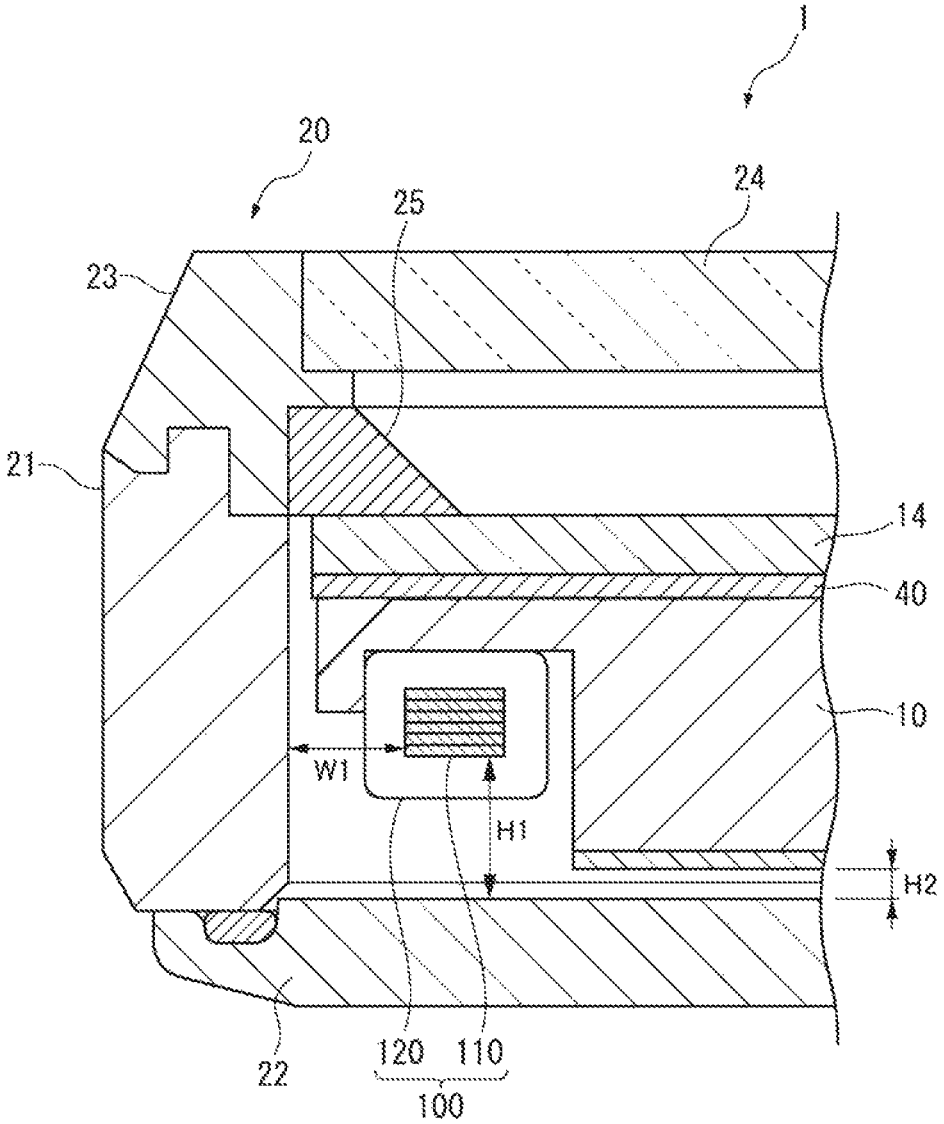
FIG. 2 is a cross-sectional view showing a positional relationship between an outer case or a back cover and an antenna of the electronic timepiece according to the embodiment.

As also shown in FIG. 2, the outer case 20 includes a case main body 21 in a substantially cylindrical shape, a back cover 22 which closes an opening on the lower surface side of the case main body 21, a bezel 23 in a ring shape attached to the case main body 21 on the upper surface side thereof by a fitting structure, and a cover glass 24 attached to the inner circumferential surface of the bezel 23.

The case main body 21 and the back cover 22 are produced with JIS Class 80 titanium alloy as described later. The bezel 23 of the outer case 20 maybe produced with the same JIS Class 80 titanium alloy as that of the case main body 21, but is formed from a ceramic in this embodiment. In the case where the bezel 23 is overlapped with the antenna 100 when viewing the electronic timepiece 1 from the cover glass 24 side in a plan view, by forming the bezel 23 from a ceramic, the bezel 23 does not affect the reception of radio waves, and therefore, a decrease in the receiving sensitivity can be prevented.

In the outer case 20, the module 10, a solar panel disposed on the front side of the module 10, the light-transmissive dial plate 14 disposed on the front side of the solar panel 40, and a dial ring 25 disposed on the front side of an outer circumferential portion of the dial plate 14 are disposed.

The module 10 adopts a general structure in which other than the antenna 100, a main plate, a circuit board, a stepping motor, a drive train, and the like are incorporated, and therefore, the description thereof is omitted below.

As shown in FIG. 1, the antenna 100 for receiving radio waves is a bar antenna and is disposed in the position of 9 o'clock of the timepiece in the outer case 20.

The antenna 100 is constituted by an antenna core 110 and a coil 120 wound around the antenna core 110.

The antenna core 110 includes a coil wound section 111, around which the coil 120 is wound, and a lead section 112, which extends from both end sides of the coil wound section 111, and is formed in an elongated shape. Here, the coil wound section 111 is formed in a linear shape and the lead section 112 is formed in an arc shape. The antenna core 110 is formed by, for example, shaping a cobalt-based amorphous foil (for example, an amorphous foil containing Co in an amount of 50 wt % or more) as a magnetic foil material by punching with a die or etching, and overlapping about 10 to 30 sheets of the shaped foil materials with one another, and then performing a heat treatment such as annealing to stabilize the magnetic properties.

Then, as shown in FIG. 2, the antenna core 110 is constituted by stacking plate-shaped amorphous foils in the thickness direction of the electronic timepiece 1 (a direction connecting the cover glass 24 to the back cover 22). The antenna core 110 is not limited to a stacked amorphous foil, and ferrite may be used, and in such a case, the antenna core may be produced by shaping a ferrite material with a die or the like and performing a heat treatment.

When the coil 120 receives a long wave standard radio wave (40 to 77.5 kHz), an inductance of about 10 mH is desired. Due to this, in this embodiment, the coil 120 is constituted by winding about several hundred turns of a polyurethane enamel copper wire having a diameter of about 0.1 μm.

The case main body 21 and the back cover 22 of the outer case 20 are formed from a titanium alloy composed of Al (aluminum) in an amount of 3.50 mass % or more and 4.50 mass % or less and V (vanadium) in an amount of 20.00 mass % or more and 23.00 mass % or less, with the remainder including Ti (titanium) and impurities (i.e., 3.50 mass % Al 4.50 mass % and 20.00 mass % V 23.00 mass o, hereinafter referred to as "JIS Class 80 titanium alloy").

The JIS Class 80 titanium alloy of this embodiment contains the following trace elements as impurities: N (nitrogen) in an amount of 0.05 mass % or less, C (carbon) in an amount of 0.10 mass % or less, H (hydrogen) in an amount of 0.0150 mass % or less, Fe (iron) in an amount of 1.00 mass % or less, and O (oxygen) in an amount of 0.25 mass % or less. These trace elements are not intentionally added and are inevitable impurities incorporated in the production process. Due to this, the JIS Class 80 titanium alloy which does not contain all or some of these elements (N, C, H, Fe, and O) by changing the production process or the like may be used. Therefore, in the JIS Class 80 titanium alloy of this embodiment, N, C, H, Fe, and O are arbitrary components which may be or may not be contained.

The JIS Class 80 titanium alloy has excellent cold workability, and the case main body 21 or the back cover 22 can be produced by cold forging. Therefore, as compared with the case where JIS Class 60 titanium alloy is used for the case main body 21 or the back cover 22 and therefore a cutting process is required for production, the productivity can be improved.

Figure 3:
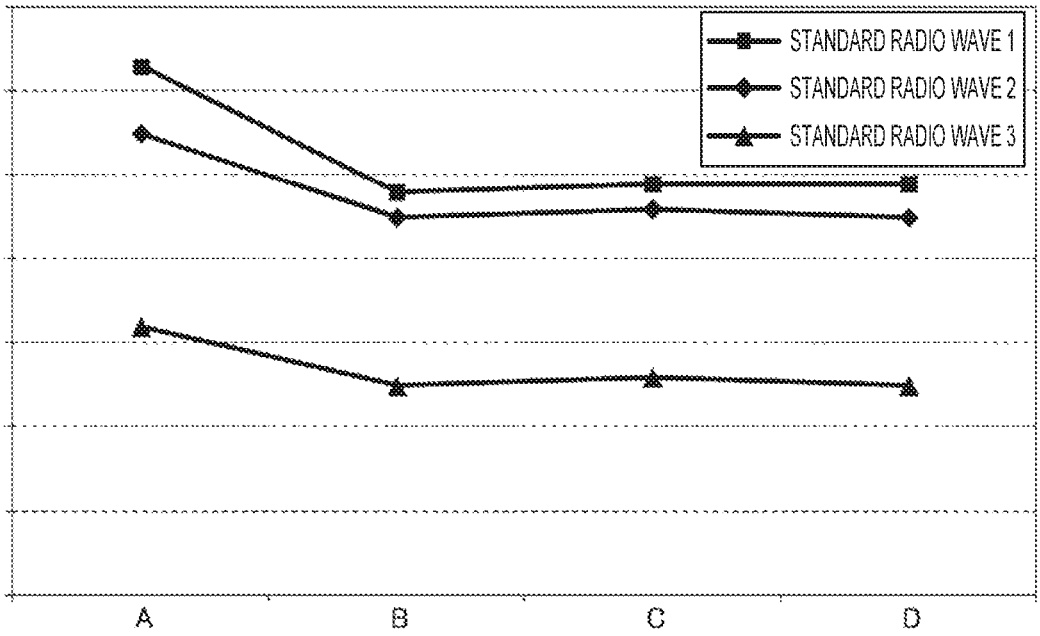
FIG. 3 is a graph showing a relationship between a gap dimension between the antenna and the back cover and receiving sensitivity when receiving three types of standard radio waves.

FIG. 3 shows experimental data of a relationship between a gap dimension H1 between the antenna 100 and the back cover 22 and receiving sensitivity when receiving three types of standard radio waves. In FIG. 3, the experiment was performed using the following three types of standard radio waves: DCF77 (a standard radio wave from Germany), BPC (a standard radio wave from the People's Republic of China), and JJY60 (a standard radio wave from Japan). Further, the size of the outer case 20 used in the experiment is as follows: vertical dimension (the total length including the tip of a case foot): about 36 mm, horizontal dimension: about 28 mm, thickness dimension: about 9 mm.

In this experimental example, the gap dimension H1 between the antenna 100 incorporated in the module 10 and the back cover 22 is changed by changing a gap dimension H2 between the back cover 22 and the module 10.

The vertical axis in FIG. 3 represents the receiving sensitivity and it is indicated that as the graph goes down, the receiving sensitivity is improved.

"A" in the horizontal axis shows the receiving sensitivity of Comparative Example A in which the case main body 21 and the back cover 22 were produced with Ti (pure titanium), and the gap dimension H2 was set to 0.68 mm (the gap dimension H1 was set to 2.05 mm).

"B" in the horizontal axis shows the receiving sensitivity of Example B in which the case main body 21 and the back cover 22 were produced with the JIS Class 80 titanium alloy, and the gap dimension H2 was set to 0.68 mm (the gap dimension H1 was set to 2.05 mm).

"C" in the horizontal axis shows the receiving sensitivity of Example C in which the case main body 21 and the back cover 22 were produced with the JIS Class 80 titanium alloy, and the gap dimension H2 was set to 0.48 mm (the gap dimension H1 was set to 1.85 mm).

"D" in the horizontal axis shows the receiving sensitivity of Example D in which the case main body 21 and the back cover 22 were produced with the JIS Class 80 titanium alloy, and the gap dimension H2 was set to 0.28 mm (the gap dimension H1 was set to 1.65 mm).

Ti (pure titanium) has a specific resistance of $55\times10^{-8}$ Ωm and is likely to generate an eddy current. Due to this, the antenna 100 is disposed away from the case main body 21 or the back cover 22, and as shown in FIG. 3, in Comparative Example A, by greatly separating these members from each other such that the gap dimension H1 was set to 2.05 mm, the desired receiving sensitivity for a product can be ensured.

On the other hand, in Example B, the gap dimension H1 was set to 2.05 mm in the same manner as in Comparative Example A, however, the case main body 21 and the back cover 22 were produced with the JIS Class 80 titanium alloy having a specific resistance as high as $148\times10^{-8}$ Ωm, and therefore, a loss due to an eddy current can be also reduced, and the receiving sensitivity for each standard radio wave is improved as compared with Comparative Example A.

In Example C, the gap dimension H1 was decreased as compared with Example B and set to 1.85 mm, and in Example D, the gap dimension H1 was further decreased and set to 1.65 mm. As shown in FIG. 3, also in the case of Examples C and D, the receiving sensitivity for each standard radio wave can be maintained at a level comparable to that in the case of Example B. That is, even if the gap dimension between the antenna 100 and the back cover 22 is decreased, an eddy current is hardly generated when the JIS Class 80 titanium alloy is used, and therefore, the receiving sensitivity can be maintained at a substantially constant level while maintaining the improved level as compared with Comparative Example A.

Therefore, in the case where the outer case 20 with a case size of this example was used, the gap dimension H1 may be set to 2.05 mm or less and 1.65 mm or more.

As the volume of the outer case 20 decreases, the effect of the eddy current also decreases. Therefore, in the case where the case size is further reduced, the lower limit of the gap dimension H1 with the back cover 22 can be further decreased.

Further, with respect to the gap dimension H1, a minimum dimension is set according to the waterproof performance (for example, 10 atm waterproof or the like) desired for the electronic timepiece 1. That is, as the gap dimension H1, it is desirable to ensure a dimension so that even if the back cover 22 is recessed inside the outer case 20 by water pressure, the back cover does not come into contact with the module 10.

Therefore, the lower limit of the gap dimension H1 may be set in consideration of the effect of the eddy current and the effect of the waterproof performance, and for example, in the case of a small-sized electronic timepiece 1 intended for women, the lower limit of the gap dimension H1 can be decreased to about 1.55 mm.

Figure 4:
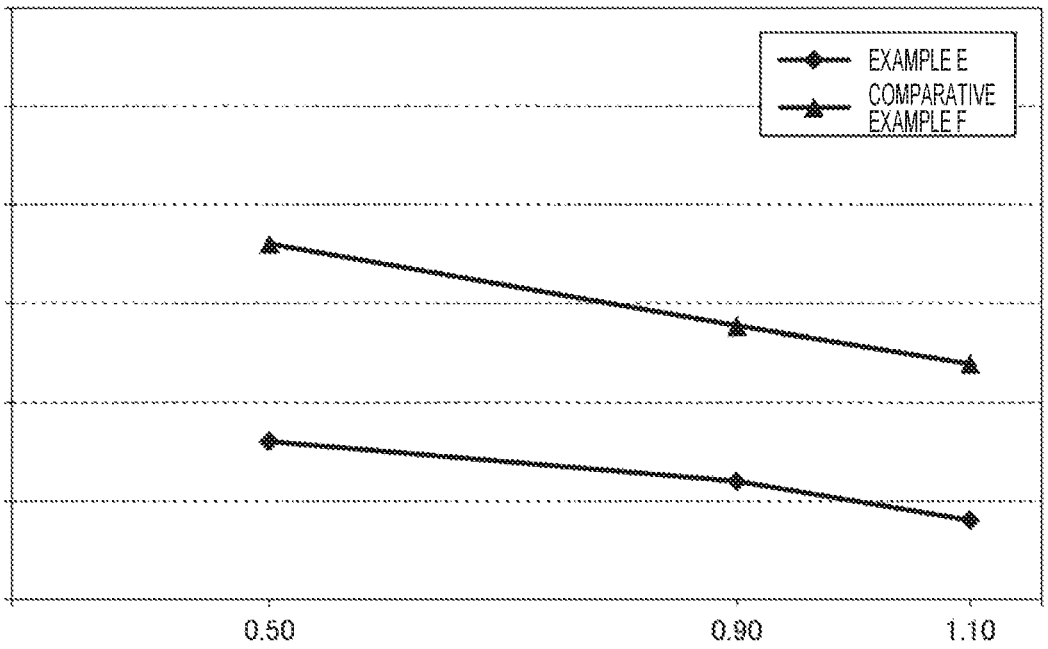
FIG. 4 is a graph showing a relationship between a gap dimension between the antenna and the outer case and receiving sensitivity when receiving a standard radio wave.

FIG. 4 shows experimental data of a relationship between a gap dimension W1 of the antenna 100 and the case main body 21 and receiving sensitivity when receiving a standard radio wave. The gap dimension W1 represented by the horizontal axis in FIG. 4 is a gap dimension of a portion where the antenna core 110 and the inner surface of the outer case 20 come closest to each other, and in this embodiment, it is a gap dimension between the lead section 112 of the antenna core 110 and the inner surface of the outer case 20.

The data of Example E are experimental data in the case where three types of case main bodies 21 in which the gap dimension W1 between the antenna 100 and the case main body 21 was set to 0.50 mm, 0.90 mm, or 1.10 mm were produced with the JIS Class 80 titanium alloy. The data of Comparative Example F are experimental data in the case where three types of case main bodies 21 in which the gap dimension W1 was set to 0.50 mm, 0.90 mm, or 1.10 mm were produced with Ti (pure titanium).

The vertical axis in FIG. 4 represents the receiving sensitivity in the same manner as in FIG. 3 and it is indicated that as the graph goes down, the receiving sensitivity is improved.

As shown in FIG. 4, in any of the cases where the gap dimension W1 was 0.50 mm, 0.90 mm, or 1.10 mm, an eddy current was hardly generated in Example E in which the case main body 21 and the back cover 22 were produced with the JIS Class 80 titanium alloy, and therefore, the receiving sensitivity was improved as compared with Comparative Example F. In either of Example E and Comparative Example F, as the gap dimension W1 is increased, the receiving sensitivity is improved. Further, according to Example E, when the gap dimension W1 is at least 0.50 mm or more, the sensitivity can be improved as compared with the case where the gap dimension W1 is set to 1.10 mm in Comparative Example F. Therefore, the gap dimension W1 is preferably set to 0.50 mm or more.

Further, as the gap dimension W1 is increased, the size of the case is increased, and therefore, the gap dimension W1 is preferably set to 1.10 mm or less.

That is, the gap dimension W1 between the antenna 100 and the case main body 21 may be set in consideration of the effect of the eddy current depending on the size (volume) of the outer case 20 and the size of the case main body 21.

According to the above embodiment, the following effects are exhibited.

(1) According to this embodiment, the case main body 21 and the back cover 22 of the outer case 20 are produced with the JIS Class 80 titanium alloy having a higher specific resistance than Ti, SUS 304, and SUS 316, and therefore, a loss due to an eddy current can be reduced. Due to this, the receiving sensitivity can be maintained even if the antenna core 110 is brought closer to the case main body 21 or the back cover 22, and therefore, a reduction in the thickness or the size of the electronic timepiece 1 can be achieved. As a result, a watch intended for women can also be easily realized.

(2) The case main body 21 and the back cover 22 are produced with the JIS Class 80 titanium alloy, and therefore, the case main body 21 and the back cover 22 can be produced by cold forging. Due to this, the dimensional accuracy of the case main body 21 and the back cover 22 can be improved, and a minimum gap can be ensured even if the module 10 is disposed closer to the case main body 21 or the back cover 22. Therefore, even in the electronic timepiece 1 such as a watch, a further reduction in the thickness or the size of the electronic timepiece can be achieved.

(3) The case main body 21 and the back cover 22 are produced with the JIS Class 80 titanium alloy, and therefore, the case main body 21 and the back cover 22 can be produced by cold forging. Due to this, the case main body 21 and the back cover 22 can be produced without a cutting process, but instead by forging, and therefore, the productivity can be improved as compared with the case where the case main body 21 and the back cover 22 are produced with JIS Class 60 titanium alloy.

Modification of Embodiment

The invention is not limited to the above-mentioned embodiment, and the invention includes modifications, improvements, and the like, within the scope capable of achieving an object of the invention.

The electronic timepiece 1 may be configured such that the case main body 21 is produced with the JIS Class 80 titanium alloy, and the back cover 22 is produced with pure titanium, SUS 304, or SUS 316.

Further, the electronic timepiece 1 may be configured such that the back cover 22 is produced with the JIS Class 80 titanium alloy, and the case main body 21 is produced with pure titanium, SUS 304, or SUS 316.

Also in the case where only one of the case main body 21 and the back cover 22 is produced with the JIS Class 80 titanium alloy, the receiving sensitivity can be improved as compared with the case where both the case main body 21 and the back cover 22 are produced with pure titanium.

Figure 5:
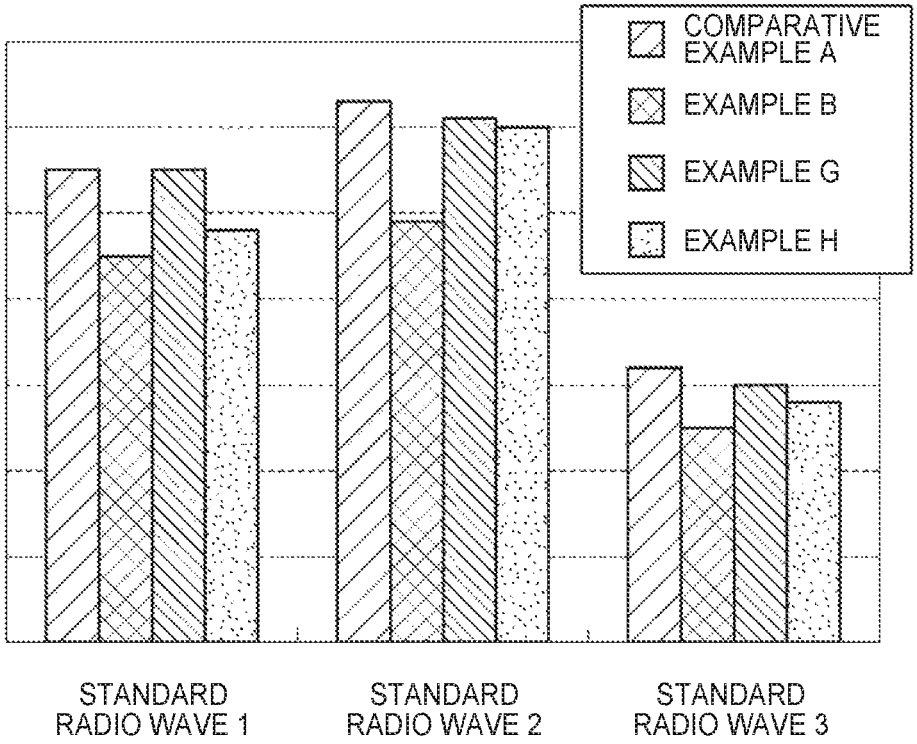
FIG. 5 is a graph showing a relationship between a material of the outer case and the back cover and receiving sensitivity when receiving a standard radio wave.

FIG. 5 is a graph of experimental data showing a relationship between a combination of materials of the case main body 21 and the back cover 22 and receiving sensitivity when receiving three types of standard radio waves.

Comparative Example A is Comparative Example A described with respect to FIG. 3, and the data of Comparative Example A are experimental data in the case where the case main body 21 and the back cover 22 were produced with the Ti (pure titanium), and the gap dimension H2 was set to 0.68 mm (the gap dimension H1 was set to 2.05 mm).

Example B is Example B described with respect to FIG. 3, and the data of Example B are experimental data in the case where the case main body 21 and the back cover 22 were produced with the JIS Class 80 titanium alloy, and the gap dimension H2 was set to 0.68 mm (the gap dimension H1 was set to 2.05 mm).

The data of Example G are experimental data in the case where the case main body 21 was produced with the JIS Class 80 titanium alloy and the back cover 22 was produced with Ti (pure titanium), and the gap dimension H2 was set to 0.68 mm (the gap dimension H1 was set to 2.05 mm).

The data of Example H are experimental data in the case where the case main body 21 was produced with Ti (pure titanium) and the back cover 22 was produced with the JIS Class 80 titanium alloy, and the gap dimension H2 was set to 0.68 mm (the gap dimension H1 was set to 2.05 mm).

According to the experimental results shown in FIG. 5, in the case of the standard radio wave 1 (DCF77), as compared with Comparative Example A, the receiving sensitivity was improved by about 4% in Example B, and improved by 3% in Example H. Further, in the case of the standard radio wave 2 (BPC), as compared with Comparative Example A, the receiving sensitivity was improved by about 6% in Example B, improved by 1% in Example G, and improved by 1% in Example H. Further, in the case of the standard radio wave 3 (JJY60), as compared with Comparative Example A, the receiving sensitivity was improved by about 3% in Example B, improved by 1% in Example G, and improved by 2% in Example H.

That is, the receiving sensitivity could be most improved in Example B in which both of the case main body 21 and the back cover 22 were produced with the JIS Class 80 titanium alloy. Further, in Example H in which the back cover 22 was produced with the JIS Class 80 titanium alloy, although the receiving sensitivity was decreased as compared with Example B, the receiving sensitivity could be improved as compared with Example G in which the case main body 21 was produced with the JIS Class 80 titanium alloy. In Example G, although the receiving sensitivity was decreased as compared with Example H, the receiving sensitivity could be improved as compared with Comparative Example A. Therefore, it could be confirmed that by producing at least one of the case main body 21 and the back cover 22 with the JIS Class 80 titanium alloy, as compared with the case where the case main body 21 and the back cover 22 are produced with Ti (pure titanium), the receiving sensitivity can be improved. Further, in the case where at least one of the case main body 21 and the back cover 22 was produced with the JIS Class 80 titanium alloy, the receiving sensitivity could be more improved when the back cover 22 was produced by the JIS Class 80 titanium alloy than when the case main body 21 was produced by the JIS Class 80 titanium alloy.

In the above-mentioned embodiment, the antenna core 110 is configured to include the coil wound section 111 formed in a linear shape and the lead section 112 formed in an arc shape at both ends of the coil wound section 111, but may be configured such that the coil wound section 111 and the lead section 112 are disposed in a straight line. In particular, in the case where the outer case is in a rectangular shape or in a tonneau shape (barrel shape), the antenna 100 in which the coil wound section 111 and the lead section 112 are disposed in a straight line may be used.

In the above-mentioned embodiment, an example in which the solar panel 40 is fixed to the back surface of the dial plate 14 is shown, however, the invention is not limited thereto, and a configuration in which the solar panel 40 is not provided or the like may be adopted.

In the above-mentioned embodiment, time information is shown as an example of the radio information to be communicated using the antenna 100, however, the invention is not limited thereto. For example, an IC card function can be incorporated in the electronic timepiece 1 and may be utilized for transmitting and receiving information such as a train commuter pass or a variety of prepaid IC cards. For example, an IC chip and an antenna, and the like can be incorporated in the outer case 20, and the exchange of information using an IC card may be performed by bringing a watch closer to a ticket gate machine, an access management machine, a variety of charge payment machines, and the like. In such a case, it is not necessary to additionally put the IC card in and out, but rather the hand wearing the electronic timepiece 1 is brought closer to the machine, and therefore, the operability can be remarkably improved.

Accordingly, the antenna 100 to be incorporated in the outer case 20 according to the invention may be an antenna to be used for reception only as in the case of receiving a standard radio wave, or may be used for transmitting and receiving information as in the case of a tag using a non-contact IC, or may be used for transmission only. These maybe appropriately selected according to the type of antenna built-in electronic timepiece 1 to which the invention is applied.

The entire disclosure of Japanese Patent Application Nos. 2016-092586 filed May 2, 2016 and 2017-024054 filed Feb. 13, 2017 are expressly incorporated by reference herein.

What is claimed is:

1. An electronic timepiece, comprising:
an outer case;
a back cover secured to the outer case; and
an antenna disposed in the outer case, wherein
the outer case and the back cover are formed from a titanium alloy composed of:
aluminum in an amount of 3.50 mass % or more and 4.50 mass % or less;
vanadium in an amount of 20.00 mass % or more and 23.00 mass % or less; and
a remainder including titanium and impurities.

2. The electronic timepiece according to claim 1, wherein
the antenna includes an antenna core and a coil wound around the antenna core, and
a gap dimension between the antenna core and the back cover is 2.05 mm or less and 1.55 mm or more.

3. The electronic timepiece according to claim 1, wherein
the antenna includes an antenna core and a coil wound around the antenna core, and
a gap dimension between the antenna core and the outer case is 1.10 mm or less and 0.50 mm or more.

4. An electronic timepiece, comprising:
an outer case;
a back cover secured to the outer case; and
an antenna disposed in the outer case, wherein
the back cover is formed from a titanium alloy composed of:
aluminum in an amount of 3.50 mass % or more and 4.50 mass % or less;
vanadium in an amount of 20.00 mass % or more and 23.00 mass % or less; and
a remainder including titanium and impurities.

5. The electronic timepiece according to claim 4, wherein
the antenna includes an antenna core and a coil wound around the antenna core, and
a gap dimension between the antenna core and the back cover is 2.05 mm or less and 1.55 mm or more.

6. An electronic timepiece, comprising:
an outer case;
a back cover secured to the outer case; and
an antenna disposed in the outer case, wherein
the outer case is formed from a titanium alloy composed of:
aluminum in an amount of 3.50 mass % or more and 4.50 mass % or less;
vanadium in an amount of 20.00 mass % or more and 23.00 mass % or less; and
a remainder including titanium and impurities.

7. The electronic timepiece according to claim 6, wherein
the antenna includes an antenna core and a coil wound around the antenna core, and
a gap dimension between the antenna core and the outer case is 1.10 mm or less and 0.50 mm or more.

* * * * *